US006085708A

United States Patent [19]

Trzmiel et al.

[11] Patent Number: 6,085,708

[45] Date of Patent: Jul. 11, 2000

[54] DEVICE FOR HYDRAULIC ROTATIONAL ANGLE ADJUSTMENT OF A SHAFT RELATIVE TO A DRIVE WHEEL

[75] Inventors: Alfred Trzmiel, Grafenberg; Wolfgang Stephen, Boll; Axel-Willi Jochim, Nuertingen, all of Germany

[73] Assignees: Hydraulik Ring GmbH, Neurtingen; Dr. Ing. h.c.F. Porsche AG, Weissach, both of Germany

[21] Appl. No.: 09/213,234

[22] Filed: Dec. 17, 1998

[30] Foreign Application Priority Data

Dec. 17, 1997 [DE] Germany ..... 197 56 016

[51] Int. Cl.[7] ..... F01L 1/344

[52] U.S. Cl. ..... 123/90.17; 123/90.31

[58] Field of Search ..... 123/90.12, 90.15, 123/90.17, 90.31; 74/568 R; 464/1, 2, 160

[56] References Cited

U.S. PATENT DOCUMENTS

| | | | |
|---|---|---|---|
| 4,858,572 | 8/1989 | Shirai et al. | 123/90.15 |
| 5,067,450 | 11/1991 | Kano et al. | 123/90.17 |
| 5,080,052 | 1/1992 | Hotta et al. | 123/90.17 |
| 5,090,365 | 2/1992 | Hotta et al. | 123/90.17 |
| 5,215,046 | 6/1993 | Takenaka et al. | 123/90.17 |
| 5,218,935 | 6/1993 | Quinn, Jr. et al. | 123/90.17 |
| 5,341,777 | 8/1994 | Miura et al. | 123/90.17 |
| 5,421,294 | 6/1995 | Ruoff et al. | 123/90.17 |
| 5,520,145 | 5/1996 | Nagai et al. | 123/90.17 |
| 5,535,705 | 7/1996 | Eguchi et al. | 123/90.17 |
| 5,605,121 | 2/1997 | Scheidt et al. | 123/90.17 |
| 5,797,361 | 8/1998 | Mikame et al. | 123/90.17 |

FOREIGN PATENT DOCUMENTS

| | | |
|---|---|---|
| 0652354A1 | 5/1995 | European Pat. Off. . |
| 3937644A1 | 5/1991 | Germany . |
| 4108111A1 | 10/1991 | Germany . |

*Primary Examiner*—Weilun Lo
*Attorney, Agent, or Firm*—Evenson, McKeown, Edwards & Lenahan, P.L.L.C.

[57] ABSTRACT

A device for relative rotational angle changing of the camshaft of an internal combustion engine relative to its drive wheel has an inner part connected with ribs or vanes that is located rotationally movably in a compartmented wheel. This driven compartmented wheel has a plurality of compartments distributed around the circumference divided by ribs or vanes into two pressure chambers each, and with the change in rotational angle being produced by their pressurization. To minimize the influence of overlapping alternating torque influences from the valve drive of the internal combustion engine, damping structure is integrated into this device to damp the change in rotational position change hydraulically.

11 Claims, 3 Drawing Sheets

DEVICE FOR HYDRAULIC ROTATIONAL ANGLE ADJUSTMENT OF A SHAFT RELATIVE TO A DRIVE WHEEL

BACKGROUND AND SUMMARY OF THE INVENTION

This application claims the priority of German application 197 56 016.4, filed in Germany on Dec. 17, 1997, the disclosure of which is expressly incorporated by reference herein.

The invention relates to a device for hydraulic rotational angle adjustment of a shaft relative to a drive wheel, especially the camshaft of an internal combustion engine. Preferred embodiments of the invention relate to such a device having an inner part connected nonrotatably with the camshaft, said inner part having at least approximately radial ribs or vanes, and a driven compartmented wheel that has a plurality of compartments distributed around the circumference, which are subdivided by ribs or vanes into two pressure chambers, which, when pressurized, rotate the camshaft relative to the compartmented wheel by pressure acting on the ribs or vanes.

A device of this kind is known for example from U.S. Pat. No. 4,858,572. In this device, an inner part is connected nonrotatably with the end of the camshaft, which has on its exterior a plurality of radial slots distributed around the circumference, in which slots vane elements are guided radially displaceably. This inner part is surrounded by a compartmented wheel which comprises a plurality of hydraulically pressurizable compartments that are divided by the vanes into two pressure chambers that act against one another on the compartments. By pressurization of these pressure chambers, depending on the pressure differential, the compartmented wheel can be rotated relative to the inner part and hence to the camshaft. In addition, in the compartmented wheel, a hydraulically pressurizable piston is guided in each of two radial bores in defined angular positions, said pistons being capable of being pushed into a radial depression of the inner part in the associated end position of the device. These pistons are urged by compression spring elements in the direction of the inner part and are displaceable in the opposite direction by hydraulic pressurization of the bores in the inner ring. The device is intended to be locked in one of its two end positions by these spring-loaded pistons, provided the pressure for pressurizing the pressure chambers has not yet reached a certain level. It is only when a certain pressure level is reached that the pistons are pushed back against the action of the compression springs and allow the inner part to rotate relative to the compartmented wheel. With such a device, it is intended among other things to eliminate rattling noises when starting the internal combustion engine, said noises being produced by alternating changes in torque when starting and operating the internal combustion engine.

In addition, a device for hydraulic rotational angle adjustment of a camshaft relative to its drive wheel is known from German Patent Document DE 39 37 644 A1, in which a plurality of radially-extending ribs is permanently connected to an inner part that is nonrotatably connectable with the camshaft, said ribs being rotationally movable in the compartments of a surrounding compartmented wheel and dividing these compartments into two pressure chambers each. Means for securing the rotational position of the shaft relative to the compartmented wheel are not provided in this case, however.

Devices of this kind for relative rotational angle changing of a camshaft relative to a drive wheel have the disadvantage that the rotational angle change, because of the alternating effect with the torque fluctuations that are caused by the valve drive during the constant rotation of the camshaft is not uniform but shows constant position deviations during the adjustment process. Devices of this kind have a more-or-less markedly nonuniform pattern of changes in rotational angle.

On the other hand, a goal of the invention is to improve a device of the above described general type for relative rotational angle changing of a camshaft of an internal combustion engine relative to a drive wheel in such fashion that the adjustment process is made uniform and the influence of alternating torques from the drive of the camshaft during the adjustment process is minimized.

This goal is achieved according to preferred embodiments of the invention, by integrating damping structure into the device to hydraulically damp the rotational angle changes of the device. By means of a hydraulically acting damping in the manner of a throttle or a diaphragm, overlapping of the rotational movement caused by the alternating torques that develop can be damped to a greater extent than the desired change in rotational angle by the pressurization of the pressure chambers. The integration of the damping structure directly into the device formed essentially by the inner part and the compartmented wheel also has the advantage that long line lengths between the damping means and the effective pressure chambers, which in turn would negatively influence the damping properties and would also involve additional structural expense, are avoided.

These hydraulically acting damping structures can be designed advantageously as damping throttles between two hydraulically pressurized pressure chambers.

The damping effect is especially good if both of the pressure chambers connected by the damping throttles are constantly pressurized with system pressure, with the volume of one pressure chamber during a change in rotational angle relative to another being reduced or increased, and the enclosed pressure medium then being forced by the damping throttle out of one pressure chamber and into the other.

The damping throttle can be designed in an especially advantageous manner that is favorable from the manufacturing standpoint as a leakage channel of a certain size between the two pressure chambers.

The manufacture of such a device and the design of a damping throttle are especially simple and inexpensive from the manufacturing technology standpoint if the two pressure chambers are adjacent to one another and the damping throttle is formed by a gap of a specified size between a rib or a vane and the adjacent opposite surface of the inner part or compartmented wheel.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

DETAILED DESCRIPTION OF THE DRAWINGS

Figure 1:
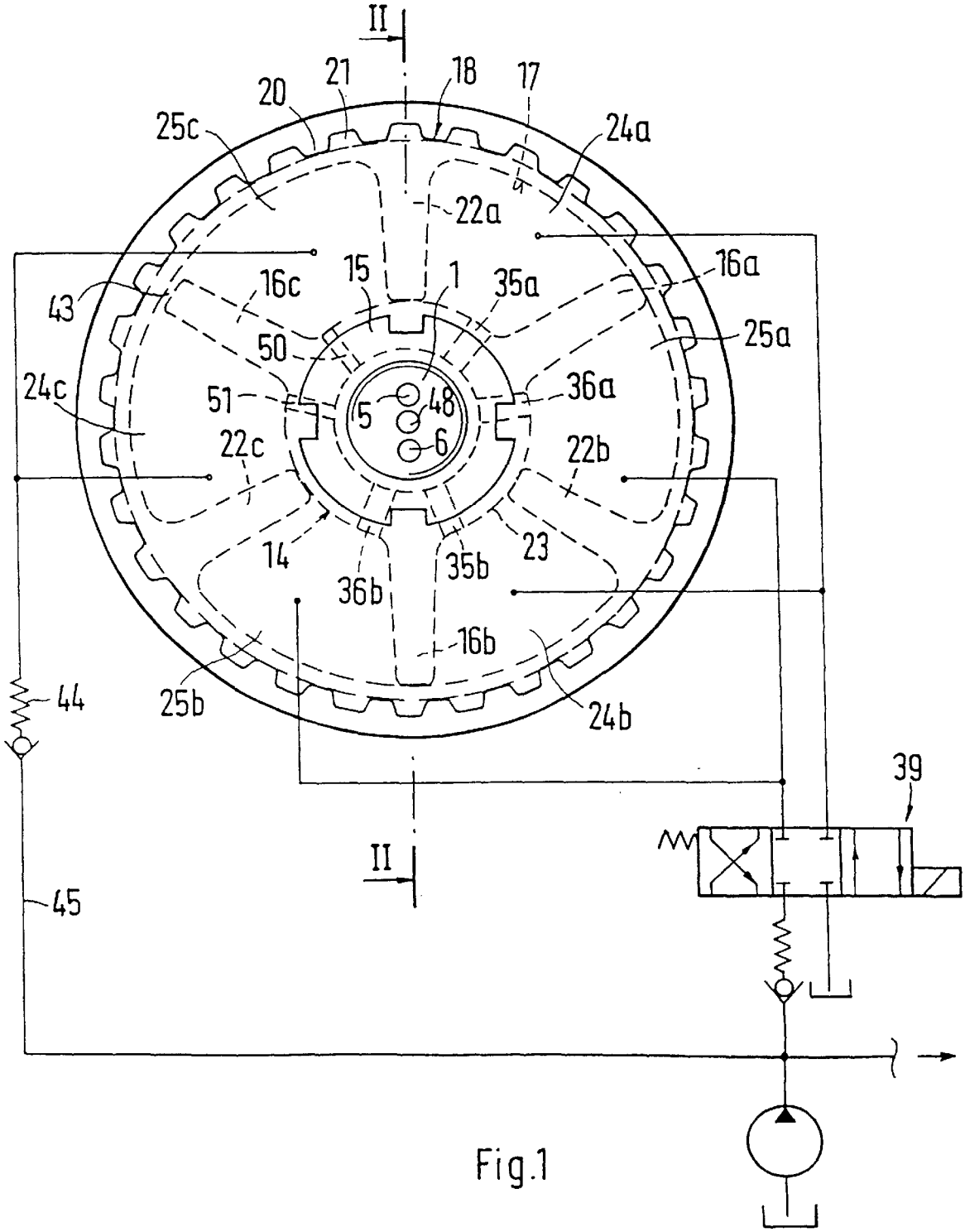
Figure 2:
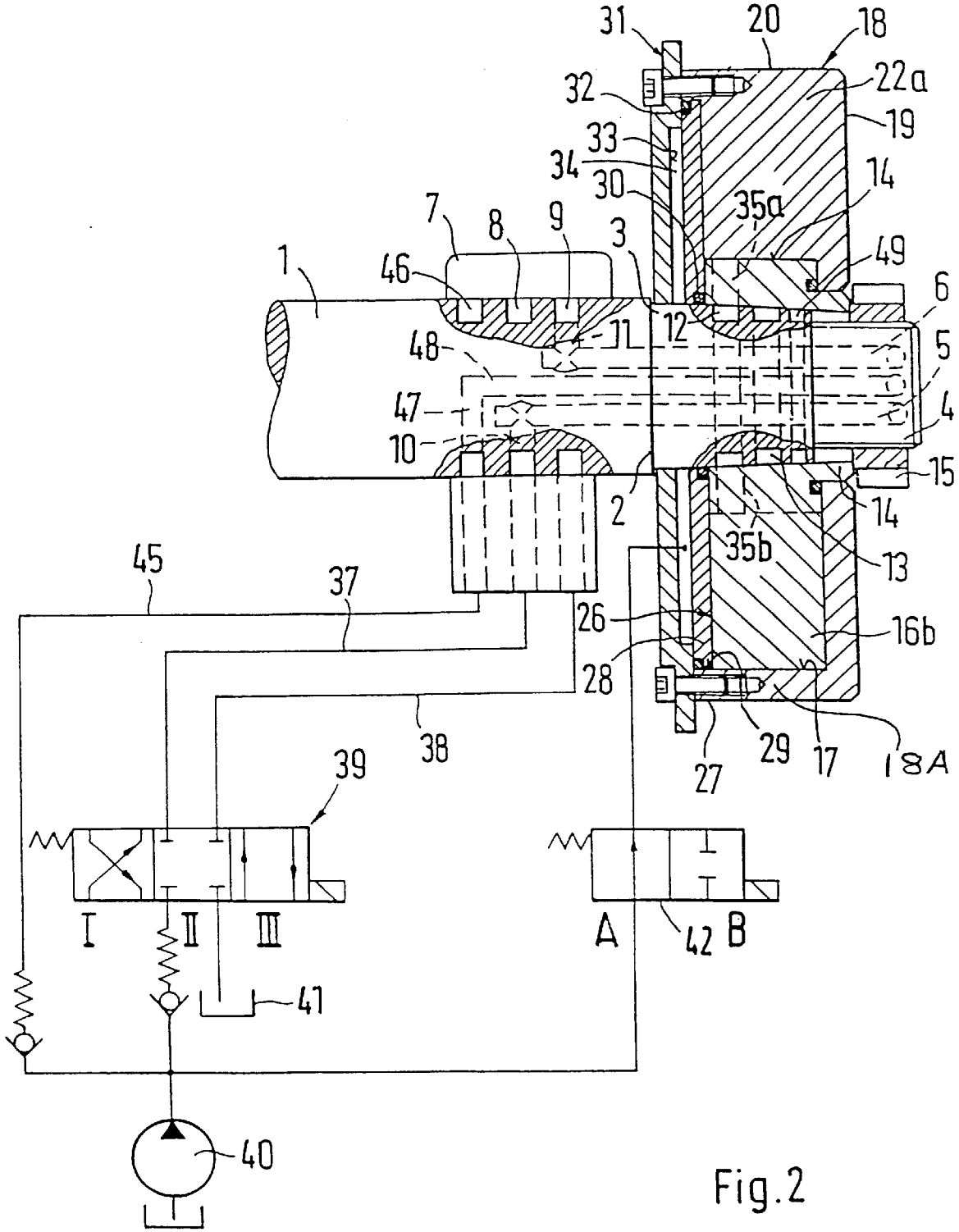
Figure 3:
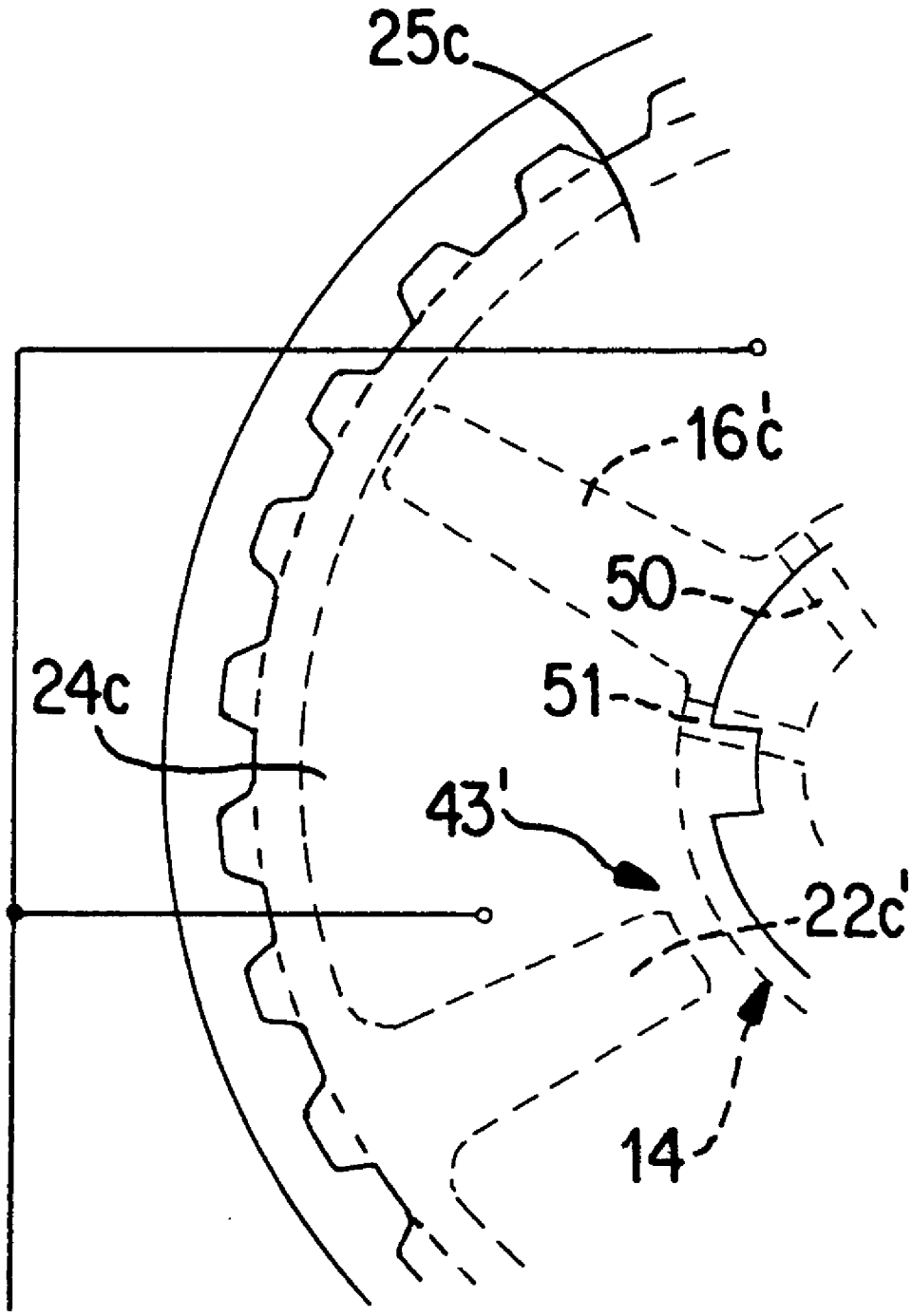

FIG. 1 is a schematic representation of a system for hydraulically controlling the camshaft rotational angle, as seen from the end of the camshaft with the pressure supply shown schematically, constructed according to a preferred embodiment of the invention, FIG. 2 is a section along line II—II in FIG. 1, likewise with the pressure supply shown schematically; and FIG. 3 is a partial view in the same direction as FIG. 1, showing a modified embodiment of the invention.

DETAILED DESCRIPTION OF THE DRAWINGS

In FIGS. 1 and 2, 1 refers to the camshaft of an internal combustion engine that is known of itself and is not shown in greater detail. This camshaft has at one end a conical segment 3 that departs from a circumferential shoulder 2, said section making a transition to a threaded pin 4. From the free end of this threaded pin 4, two spaced axial bores 5 and 6 closed endwise are located in the camshaft, said bores extending up to the vicinity of a camshaft bearing 7. In the vicinity of this camshaft bearing 7, camshaft 1 is provided at its outer circumference with two spaced annular grooves 8 and 9, which are connected by respective radial bores 10 and 11 with respective ones of the axial bores 5 and 6.

In the vicinity of conical segment 3 of camshaft 1, two circumferential annular grooves 12 and 13 are likewise provided on its outer circumference, said grooves likewise being connected by radial bores, shown only schematically, with axial bores 5 and 6 respectively. Annular groove 12 is then connected by axial bore 5 with annular groove 8 in the vicinity of the camshaft bearing, while annular groove 13 is connected by axial bore 6 with the annular groove 9 in the vicinity of the camshaft bearing.

On the conical segment 3, as viewed from the free end of the camshaft, an inner part 14 is provided, secured by a nut 15 screwed onto threaded pin 4. This nut 15 simultaneously produces a positive connection between the inner part and the conical segment 3 of the camshaft so that a nonrotatable connection results. From the outer circumference of inner part 14 in this embodiment, three radial ribs 16*a* to 16*c* extend, offset 120° from one another. Ribs 16*a* to 16*c* have their outer circumferences abutting the inner side 17 of a pot-shaped compartmented wheel 18 with a sealing action. This compartmented wheel 18 has a bottom 19 from which a circumferential edge 20 departs, said edge engaging ribs 16*a* to 16*c* . This circumferential edge 20 is provided on its exterior with teeth 21 that cooperate with a toothed belt, not shown, which drives the shaft. However, in contrast to this arrangement, it is also contemplated according to other preferred embodiments to drive the compartmented wheel by a chain drive or a gear drive for example.

Three ribs 22*a* to 22*c* distributed around the circumference and offset by 120° each extend from the inside of compartmented wheel 18 and/or of circumferential edge 20, said ribs abutting the outer circumference 23 of the inner part with a sealing action and being formed by the three compartments of the compartmented wheel. In each compartment, two pressure chambers 24*a* to 24*c* and 25*a* to 25*c* are formed by ribs 16*a* to 16*c* of the inner part and ribs 22*a* to 22*c*, and is limited in the circumferential direction. The ends of ribs 16*a* to 16*c* and 22*a* to 22*c* that face away from the shaft end are machined plane and form a common end face 26.

This end face is set back and projects from a surrounding portion of the edge. This end face 26 is abutted by a disk 28 that acts as an annular piston, said disk extending up to the inner circumference 29 of the surrounding section 27. This disk 28 that acts as an annular piston extends with its inner side up to the conical segment 3 of the camshaft and is sealed off there by a surrounding seal 30 from a camshaft and the inner part. Disk 28, on the side facing away from the shaft end, is secured in the axial direction by a surrounding lid element 31 connected with the compartmented wheel. This annular lid element in this embodiment is screwed by a plurality of screws distributed around the circumference in the vicinity of annular projection 18A with the compartmented wheel and has its inner circumference abutting the conical segment 3 of camshaft 1. By a circumferential seal 32 on the outer circumference of disk 28, the latter is sealed off from annular projection 18A and lid element 31. In the lid element, on the side facing annular piston 28, a depression 33 is formed with a smaller outer diameter. This depression forms a pressure chamber 34 in conjunction with annular piston 28.

Pressure chambers 24*a* and 24*b* are each connected with annular groove 12 by a bore 35*a* or 35*b* that runs radially in inner part 14. Pressure chambers 25*a* and 25*b* are connected with annular groove 13 in an analogous fashion, each by a radial bore 36*a* or 36*b*.

The annular grooves 8 and 9 in camshaft bearing 7 are each connected by a pressure medium line 37 or 38, shown only schematically, with a first control valve 39 which in this embodiment is designed as a 4/3-way valve. This control valve 39 is connected firstly with a pressure medium source 40 which, when used in a camshaft drive of an internal combustion engine, can be the lubricant pump. On the other hand, control valve 39 is connected with a pressure medium return 41. In the neutral switch position II of control valve 39, the pressure medium connections between pressure medium source 40 and/or pressure medium return 41 and the respective pressure chambers 24*a* and 24*b* and 25*a* and 25*b* are interrupted.

In the switch position I of the first control valve 39, pressure medium source 40 is connected through annular groove 9, axial bore 6, and annular groove 13 with pressure chambers 25*a* and 25*b*, while pressure chambers 24*a* and 24*b* are connected by annular groove 12, axial bore 5, and annular groove 8, with pressure medium return 41.

In switch position III of the first switch valve 39, the pressurization of pressure chambers 24*a* and 24*b* and 25*a* and 25*b* is reversed.

Pressure chamber 34 that acts on the disk and/or annular piston 28 is connected through a second control valve 42, which in this embodiment is designed as a 2/2-way valve, with pressure medium source 40. This second control valve 42 is so designed that in its spring-loaded neutral position A, it opens the connection between pressure chamber 34 and pressure medium source 40 and in its switched position B blocks this connection.

By pressurization of pressure chamber 34, the disk or annular piston 28 is pressed against the common end face 26, thus producing a clamping action that prevents turning of the inner part relative to the compartmented wheel. Turning of inner part 14 relative to compartmented wheel 18 by actuating a first control valve 39, because of a much greater hydraulic effective area on the side facing pressure chamber 34, is only possible when the second control valve 42 is brought into its locking position B. Then, with appropriate pressure monitoring, assurance can be provided that rotation can be allowed and/or clamping released only when a lower specified pressure level is reached.

Rib 16*c* of inner part 14 is made shorter than ribs 16*a* and 16*b* and does not reach the inner circumference 17 of compartmented wheel 18. Thus a gap 43 is formed that acts as a throttle gap. The two adjacent pressure chambers 24*a* and 24*c*, independently of the shift positions of the control valves, are pressurized constantly through a check valve 44 with system or working pressure. For this purpose, a pressure line 45 is connected through check valve 44 with pressure medium source 40. This pressure line in this embodiment is connected by an additional annular groove 46 in the camshaft in the vicinity of camshaft bearing 7 with a radial bore 47. The latter makes a transition to an additional axial bore 48, which is closed off endwise in the vicinity of the free end of the camshaft. This axial bore 48 is connected with a third annular groove 49 located in the vicinity of inner part 14, from which groove 49 a channel 50 or 51 departs, supplying pressure chamber 25*c* or 24*c*. When inner part 14 turns relative to compartmented wheel 18, depending on the rotary direction, pressure medium is forced from pressure chamber 24*c* through throttle gap 43 into pressure chamber 25*c* or from pressure chamber 25*c* into pressure chamber 24*c*. With a specified design for the size of the throttle or damping gap as a function of the volume flow or the desired adjustment rates as well as the alternating torques that develop, the overlapping rotary position fluctuations, because of the alternating torques, are damped to a much greater degree than the uniform basic volume flow due to the change in rotary position produced at the other pressure chambers by the pressure differential. The throttle gap can be formed over the entire width (in the axial direction) of the rib or over only a part of the rib width. By contrast to the embodiment shown here, the throttle gap can also be formed between one of the ribs 22*a* to 22*c* located on the compartmented wheel and the outer circumference of inner part 14. FIG. 3 schematically depicts this last mentioned embodiment wherein the throttle gap 43' is formed adjacent the radial inward end of rib 22'*c*. The rib 16'*c* is not shortened.

In addition, in contrast to the embodiment shown, the pressure supply to pressure chambers 24*c* and 25*c* can also be integrated into the actual adjusting device. For this purpose, pressure chambers 24*c* and 25*c*, similarly to pressure chambers 24*a* and 24*b* and 25*a* and 25*b* are connected by bores, not shown, with annular grooves 12 and 13. In order to ensure that pressure chambers 24*c* and 25*c* are not discharged to the pressure medium tank, a check valve that opens to the respective pressure chamber is located in these bores. It is also possible to connect both pressure chambers with only one of the two annular grooves 12 or 13. Following the initial pressurization of the adjusting device, both pressure chambers 24*c* and 25*c* are subjected to system or working pressure. In both cases, the pressure line 45, additional annular grooves 46 and 49, and the connecting bores 47 and 48 can be eliminated.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Device for changing a relative rotational position of a camshaft relative to a drive wheel of an internal combustion engine, comprising:

an inner part connected nonrotatably with the camshaft, said inner part having radial ribs or vanes, and a driven compartmented wheel that has a plurality of compartments distributed around the circumference, which are subdivided by said ribs or vanes into two respective pressure chambers, which, when pressurized, rotate the camshaft relative to the compartmented wheel by pressure acting on the ribs or vanes, wherein changes in rotational position of the inner part and the compartmented wheel are hydraulically damped by a damping throttle between adjacent pressure chambers, said damping throttle being formed as a gap of a specified size between a radial end of a respective rib or vane and a facing circumferential lead extending wall.

2. Device according to claim 1, wherein the facing circumferential wall is a radially inwardly facing circumferential wall of the compartmented wheel, and the respective rib or vane with the radial end facing the circumferential wall of the wheel is a rib or vane of the inner part.

3. Device according to claim 1, wherein the pressure chambers that cooperate with the damping throttle are constantly pressurized with system pressure.

4. Device according to claim 1, wherein the facing circumferential wall is a radially outwardly facing circumferential wall of the inner part, and the respective rib or vane with the radial end facing the circumferential wall of the inner part is a rib or vane of the wheel.

5. Device according to claim 3, wherein the gap is designed as a leakage channel of a specified size between the two pressure chambers.

6. Device according to claim 1, wherein the gap is formed between a radially inwardly facing circumferential wall of the compartmented wheel and a radially outer end of one of said ribs or vanes of said inner part, said one of said ribs or vanes being shorter than other of said ribs or vanes of the inner part.

7. A combustion engine camshaft angle adjusting assembly comprising:

a first part rotatable fixable on a camshaft, and a wheel, said first part and wheel extending annularly with respect to one another and having respective radially extending ribs which delimit a plurality of pressure chambers, an hydraulic pressure circuit operable to control the pressure in the pressure chambers and thereby change the relative rotational position of the first part and the wheel, and an hydraulic damping structure incorporated in at least one of said first part and wheel and operable to hydraulically damp pressure changes in respective adjacent ones of the pressure spaces, wherein said hydraulic damping structure includes a gap formed between a radial end of one of said ribs of one of said first part and said wheel and an annular wall of the other of said first part and said wheel.

8. An assembly according to claim 7, wherein said gap is formed between a radial outer end of said at least one of said ribs and a facing annular wall.

9. An assembly according to claim 7, wherein the wheel is disposed annularly around the first part.

10. An assembly according to claim 9 wherein said gap is formed between a radial outer end of said at least one of said ribs and a facing annular wall of said wheel.

11. An assembly according to claim 10, wherein only one of said ribs of said first part is constructed shorter than other of said ribs of said first part to thereby form the gap.

* * * * *